US006131365A

United States Patent [19]

Crockett

[11] Patent Number: 6,131,365

[45] Date of Patent: Oct. 17, 2000

[54] WALL UNIT STRUCTURAL SYSTEM AND METHOD

[76] Inventor: David P. Crockett, 147 Florida Park Dr., Palm Coast, Fla. 32137

[21] Appl. No.: 09/165,851

[22] Filed: Oct. 2, 1998

[51] Int. Cl.[7] ..... E04C 2/34

[52] U.S. Cl. ..... 52/794.1; 52/309.7; 52/309.9; 52/274; 52/283; 52/253; 52/787.1; 52/742.14; 52/745.1; 52/220.1

[58] Field of Search ..... 52/425, 426, 431, 52/309.7, 309.9, 309.11, 309.12, 265, 268, 274, 281, 283, 285.1, 293.1, 293.3, 295, 253, 677, 687, 699, 703, 582.1, 787.1, 794.1, 796.1, 742.14, 745.1, 745.13, 220.1

[56] References Cited

U.S. PATENT DOCUMENTS

| | | | |
|---|---|---|---|
| 2,440,763 | 5/1948 | Todhunter | 52/745.1 X |
| 3,145,505 | 8/1964 | Cornelius | 52/686 X |
| 3,685,241 | 8/1972 | Cooper | 52/293.1 X |
| 3,755,982 | 9/1973 | Schmidt | 52/309.11 X |
| 4,038,798 | 8/1977 | Sachs | 52/309.7 |
| 4,147,004 | 4/1979 | Day et al. . | |
| 4,163,349 | 8/1979 | Smith . | |
| 4,249,354 | 2/1981 | Wynn | 52/309.12 X |
| 4,292,775 | 10/1981 | Howard . | |
| 4,306,395 | 12/1981 | Carpenter | 52/309.12 X |
| 4,480,416 | 11/1984 | Judkins et al. . | |
| 4,532,745 | 8/1985 | Kinard | 52/309.12 X |
| 4,616,459 | 10/1986 | Shubow | 52/309.12 |
| 4,765,105 | 8/1988 | Tissington et al. | 52/309.11 |
| 4,823,534 | 4/1989 | Hebinck | 52/742.14 |
| 4,882,888 | 11/1989 | Moore . | |
| 4,964,252 | 10/1990 | Guliker | 52/285.1 X |
| 5,136,822 | 8/1992 | Blum | 52/281 X |
| 5,220,760 | 6/1993 | Dimakis . | |
| 5,224,316 | 7/1993 | Fredericks et al. . | |
| 5,345,738 | 9/1994 | Dimakis . | |
| 5,373,674 | 12/1994 | Winter, IV | 52/309.9 |
| 5,379,562 | 1/1995 | Hohmann | 52/431 X |
| 5,522,194 | 6/1996 | Graulich . | |
| 5,600,930 | 2/1997 | Drucker | 52/794.1 X |
| 5,638,651 | 6/1997 | Ford | 52/309.9 X |
| 5,937,604 | 8/1999 | Bowron | 52/426 |
| 5,953,883 | 9/1999 | Ojala | 52/309.11 X |

FOREIGN PATENT DOCUMENTS

| | | |
|---|---|---|
| 997118 | 9/1976 | Canada . |

*Primary Examiner*—Carl D. Friedman
*Assistant Examiner*—Brian E. Glessner
*Attorney, Agent, or Firm*—Edward M. Livington, Esq.

[57] ABSTRACT

A wall-unit structural system has wall units (1) with insulating structural material (2) intermediate an exterior panel (3) for fixation of outside covering and an interior panel (4) for attachment of inside wall surfacing (5). Attachment ridges (6) are spaced apart on the interior panel to provide channels or vacancies between the attachment ridges for positioning of plumbing, electrical and other lines. Tie-down members (8) such as rebar are attached vertically to the wall units for securing the wall units to the footing (21) and for securing elevated tie-down structure (20) such as roofing and/or higher sections of wall units to secured wall units in accordance with applicable building regulations and design preferences. Bottoms (12) of the wall units have attachment members (15) for attachment to base elements such as floors (14), concrete pads, footers, metallic frame bases, wooden frame bases and other structural bases. Tops (13) of the wall units have horizontal receptacles such as an attachment trough (16) for containing such structural elements as trough concrete (17), horizontal rebar (18), joists, headers, frames, reinforcements and/or other top structure. Vertical edges of the wall units have attachment structure (24, 25, 26) for attachment to adjacent linear and corner wall units.

19 Claims, 2 Drawing Sheets

20
13
19
16
18
17
8
2
3
4
1
7
8
27
11
8
27
9
15
10
21
22
14
28
19
18
23
3
2
4
6
23
27
19
3
16
18
2
4
5
6
8
1
8
23
2
3
25
24
26
1
24
4
1
24

WALL UNIT STRUCTURAL SYSTEM AND METHOD

BACKGROUND OF THE INVENTION

This invention relates to wall units for construction of walls for buildings and other structures.

Known wall units for construction of buildings and other structures include concrete block, brick, rock, wooden paneling, concrete paneling, metal paneling and various plastic paneling. All have variously advantageous features and are variously suitable for particular structural preferences. There are none known, however, that have floor anchoring, roof anchoring, tie-down-bar structure, utility-conveyance access, outside-surface adaptability and interior-wall adaptability in a manner taught by this invention.

Examples of different but related wall-unit systems are described in the following patent documents. U.S. Pat. No. 5,522,194, issued to Graulich on Jun. 4, 1996, described panel and panel core with extensive limitations to form insulation board, metal furring and steel reinforcing. U.S. Pat. Nos. 5,220,760 and 5,345,738, both issued to Dimakis on Jun. 22, 1993 and Sep. 13, 1994, respectively, described separate variations of exterior foam sheathing or coating with cover sheets on outsides of first and second major opposed surfaces. U.S. Pat. No. 5,224,316, issued to Fredricks, et al. on Jul. 6, 1993, described a composite panel as a covering for existing wall instead of structure of a wall as taught by this invention. U.S. Pat. No. 4,882,888, issued to Moore on Nov. 28, 1989, described a water-based, water-resistant coating completely covering opposite surfaces of laminated wall construction. U.S. Pat. No. 4,480,416, issued to Judkins, et al. on Nov. 6, 1984, described fastener strips for attaching plastic foam material to concrete walls. U.S. Pat. No. 4,292,775, issued to Howard on Oct. 6, 1981, described a wall structure for enclosing vertical and horizontal structure of a building frame. U.S. Pat. No. 4,174,004 issued to Day, et al. on Apr. 3, 1979, described sandwiching foam material between wooden panels and metal sheets as a composite wall panel assembly. U.S. Pat. No. 4,163,349, issued to Smith on Aug. 7, 1979, described insulated building panels at opposite sides of header bearing posts. Canadian Patent Number 997,118 issued Sep. 21, 1976, described a lightweight insulated wall with load-bearing and non-load-bearing sheet-metal sections.

SUMMARY OF THE INVENTION

In light of problems with previous building systems that have been intended to overcome inherent disadvantages of concrete block, wood and sheet metal for much present building structure, objects of patentable novelty and utility taught by this invention are to provide a wall-unit structural system which:

Can be secured to anchored footers and floors at bottoms and attached to roofs and upper building sections at tops with rebar in accordance with the most rigid building requirements for protection against natural disasters, such as hurricanes;

Allows floor-to-ceiling sections of walls having desired widths to be handled and positioned quickly, conveniently and firmly by one individual for rapid, low-cost building construction;

Can be sized and shaped for desired door frames, window frames, gables and other building features;

Has channels for discretionary positioning of utilities such as electrical lines, electrical outlets, plumbing, plumbing facilities, electrical facilities, telephone lines and security-system lines;

Has interior ridges that are structured and spaced apart for convenient attachment of interior surface walls;

Has exterior surfaces to which exterior surfacing such as stucco, paint, brick veneer, rock veneer or other siding materials can be attached quickly and firmly or against which actual brick, actual rock or other structural materials can be positioned;

Has high thermal resistance and total moisture resistance; and

Prevents infestation of termites and other pests.

This invention accomplishes these and other objectives with a wall-unit structural system having wall units with insulating structural material intermediate an exterior panel for fixation of outside covering and an interior panel for attachment of inside wall surfacing. Attachment ridges are spaced apart on the interior panel to provide channels or vacancies between the attachment ridges for positioning of plumbing, electrical and other lines. The attachment ridges are structured and positioned for fastening interior wall surfacing with fasteners such as nails, screws and bolts. Tie-down members such as rebar are attached vertically to the wall units for securing the wall units to footers and for securing roofing and/or higher sections of wall units to secured wall units in accordance with applicable building regulations and design preferences. Bottoms of the wall units have attachment members for attachment to base elements such as concrete pads, footers, metallic frame bases, wooden frame bases and other structural bases. Tops of the wall units have horizontal receptacles for containing such structural elements as cementation, rebar, joists, headers, frames, reinforcements and/or other top structure. Vertical edges of the wall units have attachment structure for attachment to adjacent linear and corner wall units.

The above and other objects, features and advantages of the present invention should become even more readily apparent to those skilled in the art upon a reading of the following detailed description in conjunction with the drawings wherein there is shown and described illustrative embodiments of the invention.

BRIEF DESCRIPTION OF DRAWINGS

This invention is described by appended claims in relation to description of a preferred embodiment with reference to the following drawings which are described briefly as follows:

DESCRIPTION OF PREFERRED EMBODIMENT

Figure 1:
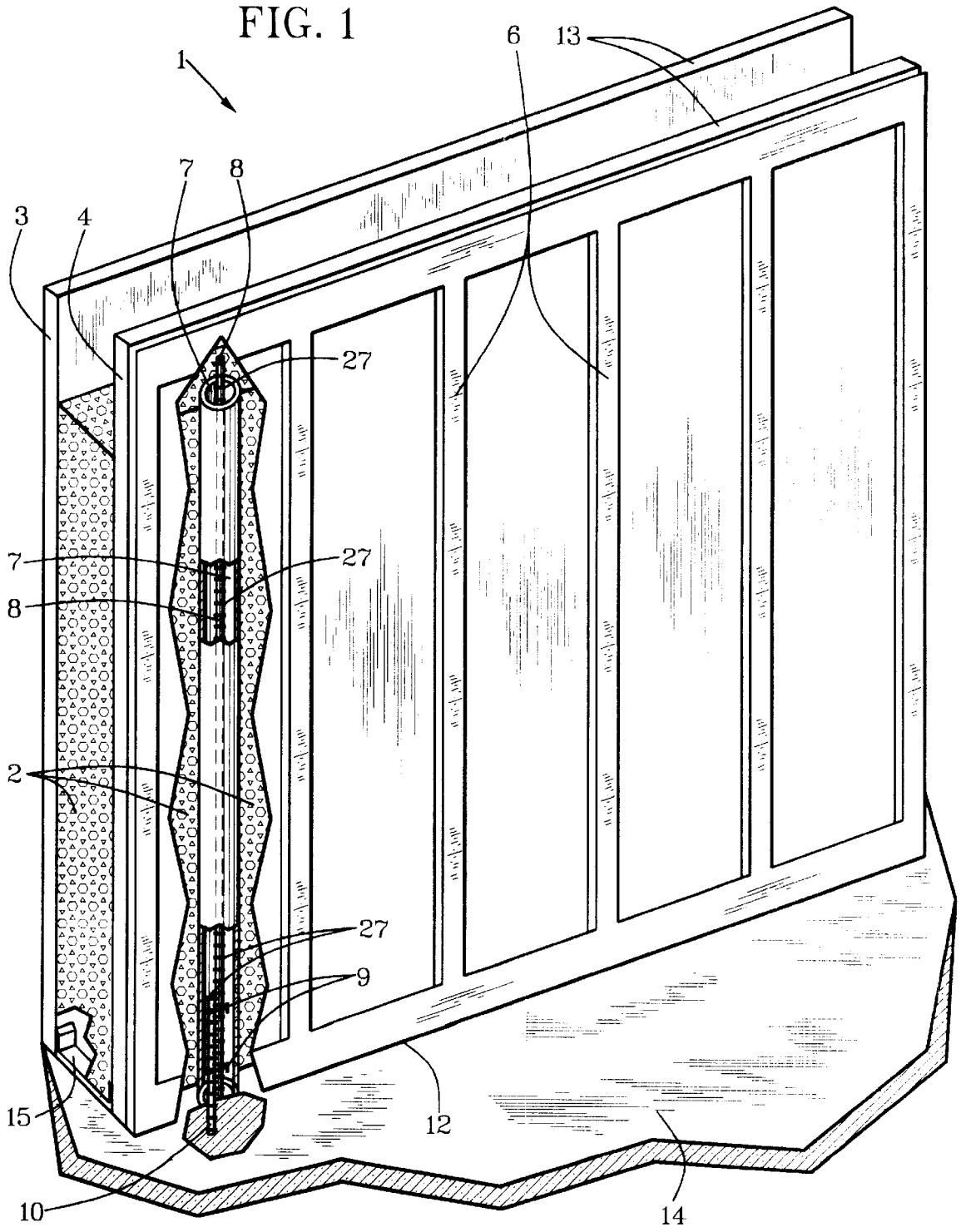
FIG. 1 is a partially cutaway perspective view of a wall unit having a single tie-down space proximate one end.

Terms used to describe features of this invention are listed below with numbering in the order of their initial use with reference to the drawings. These terms and numbers assigned to them designate the same features wherever used throughout this description.

1. Wall unit
2. Insulating structural material
3. Exterior panel
4. Interior panel
5. Inside wall surfacing
6. Attachment ridges
7. Tie-down space
8. Tie-down member
9. Tie-down attachments
10. Footer upright rebar
11. Cementitious material
12. Bottom edge of wall unit
13. Top edge of wall unit
14. Floor
15. Bottom attachment member
16. Attachment trough
17. Trough concrete
18. Horizontal rebar
19. Wire hold down
20. Elevated tie-down structure
21. Footing
22. Horizontal footing rebar
23. Exterior attachment surface
24. Attachment flanges
25. Corner plates
26. Straight plates
27. Rebar appendages
28. Hold-down hooks Reference is made first to FIGS. 1–5. A wall unit 1 has insulating structural material 2 intermediate an exterior panel 3 and an interior panel 4 for attachment of inside wall surfacing 5 shown in FIG. 5. A plurality of attachment ridges 6 are spaced apart on the interior panel 4 to provide space between the attachment ridges 6 for positioning of plumbing, electrical lines and other wall-contained items that are not shown in the drawings. The attachment ridges 6 are structured and positioned for fastening of predetermined wall surfacing 5.

At least one tie-down space 7 is oriented vertically for receiving at least one tie-down member 8 such as a rebar, tie-down attachments 9, footer upright rebar 10 and cementitious material 11 such as concrete as appropriate intermediate a bottom edge 12 and a top edge 13 of the wall unit 1. The bottom edge 12 of the wall unit 1 is attached to a floor 14 with a bottom attachment member 15 that can be a metal plate for cement floors or a wooden plate for wooden floors.

Figures 2, 3, 4, 5, 6, 7:
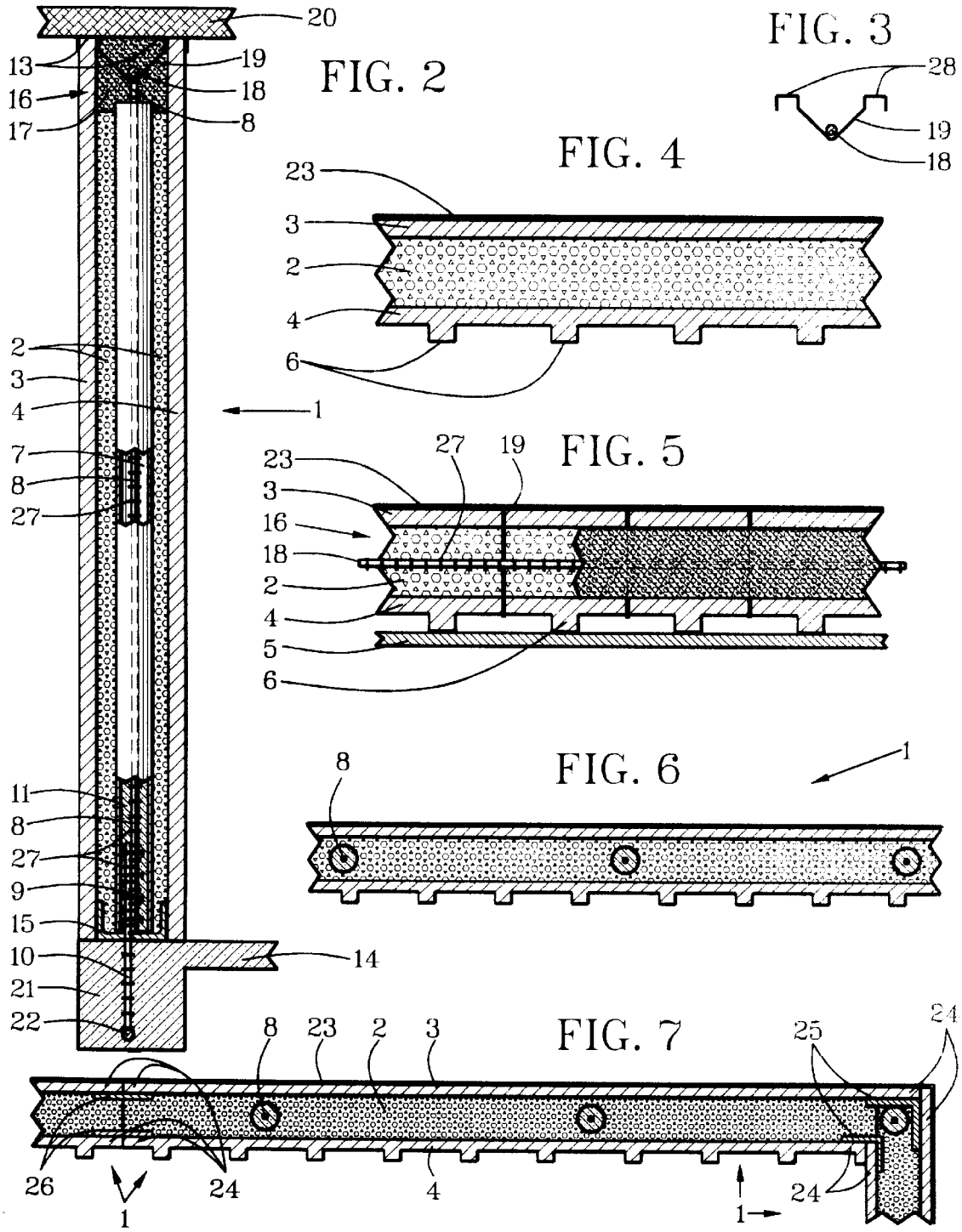
FIG. 2 is a partially cutaway end view of a wall unit with a tie-down member attached to roof structure at a top and to footer structure at a bottom.
FIG. 3 is a side view of a wire hold down.
FIG. 4 is a top view of a portion of a wall unit.
FIG. 5 is a partially cutaway top view of a portion of a wall unit with addition of horizontal roofing rebar, wire hold downs and grout or cement for rigid joining of roofing structure to hold-down members that are affixed to footing structure.
FIG. 6 is a top view of a portion of a wall unit having a plurality of tie-down members in tie-down spaces.
FIG. 7 is a top view of corner wall units and adjacent wall units joined together at flanged portions.

As depicted in FIGS. 2–3 and 5, a top-attachment portion has a top-attachment trough 16 for receiving cementitious material such as trough concrete 17 intermediate top portions of the exterior panel 3 and the interior panel 4 and on top of the insulating structural material 2. Horizontal rebar 18 is suspended into the attachment trough 16 with a wire hold down 19 and then cemented with the trough concrete 17.

Elevated tie-down structure 20 is anchored to footing 21 having appropriate horizontal footing rebar 22 by attachment of the tie-down member 8 to the footer upright rebar 10, by attachment of the horizontal rebar 18 and the wire hold down 19 to the tie-down member 8 and then by attaching the elevated tie-down structure 20 to the horizontal rebar 18 and the wire hold down 19.

As depicted in FIGS. 4–7, an exterior attachment surface 23, such as non-woven fiber glass in a plastic resin, can be provided for attachment of exterior surfacing such as stucco, brick veneer, rock veneer, siding or paint.

The insulating structural material 2 can be a foamed plastic, foamed concrete, light-filler concrete or other air cellular product for light weight of the wall units 1. This allows them to be lifted into place easily and still be strong and insulating .

The elevating tie-down structure 20 can be tie-down portions of roofing or of upper stories of a building.

Referring to FIG. 6, one or a plurality of tie-down members 8 can be provided for a single wall unit 1. Some building codes, particularly in hurricane areas, require a vertical tie down every four feet. Tie-down members 8 can be at edges and/or spaced between edges, depending on weight of materials used and applicable building codes.

Referring to FIG. 7, surfaces of the exterior panel 3 and the interior panel 4 can be attachment flanges 24 connecting members, such as preferably metallic angled corner plates 25 and straight plates 26, for connecting corner or linearly adjacent wall units 1. The attachment flanges 24 can be extended or not extended, as depicted, beyond the insulating structural material 2. Appropriate fasteners and/or cementitious material can be employed to affix the corner plates 25 and the straight plates 26 to the attachment flanges 24.

Using this wall-unit structural system includes beginning with providing a plurality of wall units 1 having tie-down members 8 that are positioned on wall units 1 to match vertical rebar such as footer upright rebar 10 from footing 21 at bottom edges 12 and that are positioned to match elevated tie-down structure 20. The wall units 1 can sized and shaped for particular construction plans and building codes. Also, the wall units 1 can be designed for convenience of construction in accordance with design preferences. Included within these parameters can be wall units 1 that are eight feet high and preferably four or more feet wide for regular portions of walls without doors, windows or other irregularities. For irregular portions of walls with windows, doors and other irregularities, short bottom and or top portions of the wall units can be constructed for positioning under and/or above such irregularities. Fabrication of irregular wall units 1 can be in accordance with standardized or custom structure.

The wall units 1 are positioned vertically upright with the tie-down members 8 in connective proximity to the vertical rebar such as the footer upright rebar 10. The tie-down members 8 are attached to the vertical rebar with such tie-down attachments 9 as appropriate for particular tying requirements. Attaching the tie-down members 8 to the vertical rebar such as footer upright rebar 10 can include pouring building material such as cementitious material 11 in the tie-down spaces 7 to cement them together with standard or special rebar appendages 27 being cemented to the same columns of cementitious material 11 in the tie-down spaces 7. Rebar appendages 27 are depicted in FIGS. 1–2 and 5.

Adjacent wall units 1 are attached linearly with the straight plates 26 and at corners with the corner plates 25 with appropriate fasteners and/or cementitious material. The bottom edges 12 of the wall units 1 are attached with the bottom attachment members 15 to base flooring such as the floor 14 that preferably is anchored with the footing 21.

Tops of the tie-down members 8 are attached to elevated tie-down structure 20 as appropriate with fasteners and/or tie lines such as the wire hold downs 19 that can have hold-down hooks 28 as shown in FIGS. 2–3 designed for predetermine tie-down structure. Trough concrete 17 can be positioned in the attachment trough 16 for cementing fixation of tie-down structure such as the horizontal rebar 18, the wire hold down 19 and the tie-down member 8. Cementitious material 11 such as concrete can be poured or variously positioned as appropriate for particular cementing requirements in complete lengths of the tie-down space 7 or in only bottom portions as depicted in FIG. 2.

A new and useful wall-unit structural system and method having been described, all such foreseeable modifications, adaptations, substitutions of equivalents, mathematical possibilities of combinations of parts, pluralities of parts, applications and forms thereof as described by the following claims and not precluded by prior art are included in this invention.

What is claimed is:

1. A wall-unit structural system comprising:

a wall unit having insulating structural material intermediate an exterior panel for fixation of outside covering and an interior panel for attachment of inside wall surfacing;

a plurality of vertical attachment ridges spaced apart on the interior panel to provide space between the attachment ridges for positioning of plumbing, electrical lines and other wall-contained items;

at least two horizontal attachment ridges one of the at least two horizontal attachment ridges being located at a top of the interior panel and another at a bottom of the interior panel for fastening the inside wall surfacing;

at least one tie-down space oriented vertically and containing at least one tie-down member such as a rebar, tie-down attachments, footer upright rebar and cementitious material as appropriate intermediate a bottom edge and a top edge of the wall unit;

a bottom attachment member proximate the bottom edge for attachment of a bottom of the wall unit to a base element such as a concrete pad, a footer, a metallic frame base, a wooden frame base and other structural bases;

a top attachment portion proximate the top edge for attachment of a top of the wall unit to an elevated tie-down structure such as a joist, a header, horizontal rebar and horizontal framework; and vertical edges of the wall units having attachment structure for attachment of the wall unit to adjacent linear and corner wall units.

2. A wall-unit structural system as described in claim 1 wherein:

the insulating structural material is a foamed plastic.

3. A wall-unit structural system as described in claim 1 wherein:

the insulating structural material is concrete.

4. A wall-unit structural system as described in claim 3 wherein:

the concrete contains light-weight particles to lighten weight of the wall unit.

5. A wall-unit structural system as described in claim 1 wherein:

the wall unit has a predetermined regular size and shape to fit intermediate a floor and a ceiling of a building.

6. A wall-unit structural system as described in claim 1 wherein:

the wall unit is specially sized and shaped as appropriate for predetermined sizes and shapes of windows, doors and other irregularities in a structure.

7. A wall-unit structural system as described in claim 1 wherein:

a surface of non-woven fibers are adhered to an exterior surface of the exterior panel with plastic cement for a base to which exterior surfacing of the exterior panel is applied.

8. A wall-unit structural system as described in claim 1 wherein:

the attachment ridges are strands that are oriented in at least one direction to form pockets intermediate the strands for containing the plumbing, electrical lines and other wall-contained items between an outside surface and an inside surface of interior wall surfacing such as wallboard that is attached to the attachment ridges.

9. A wall-unit structural system as described in claim 1 wherein:

the bottom attachment member is at least one hold-down plate having a horizontal portion that is attachable to a base surface and having a vertical portion that is attachable to inside walls of the exterior panel and to inside walls of the interior panel.

10. A wall-unit structural system as described in claim 1 wherein:

a plurality of tie-down spaces are positioned at appropriate intervals as may be required by particular building regulations and design criteria.

11. A wall-unit structural system as described in claim 1 wherein:

the top attachment member has a wire hold down for attachment to such structural members as rebar and cementitious material.

12. A wall-unit structural system as described in claim 11 wherein:

the wire hold down is attached to the exterior panel and to the interior panel.

13. A wall-unit structural system as described in claim 1 wherein:

surfaces of the exterior panel and the interior panel are attachment flanges for connecting members.

14. A wall-unit structural system as described in claim 13 wherein: the connecting members are fastening plates.

15. A wall-unit structural system as described in claims wherein:

the fastening plates include angled corner plates and straight plates.

16. A wall-unit structural system as described in claim 1 wherein:

the top-attachment portion has a top-attachment trough for receiving cementitious material such as a concrete.

17. A wall-unit structural system as described in claim 16 and further comprising:

a wire hold down having a first end attached to a top of the exterior panel and a second end attached to a top of the interior panel; and a central portion of the wire hold down is bent downwardly for holding horizontal rebar.

18. A method comprising the following steps for using a wall-unit structural system:

providing a plurality of wall units having tie-down members that are positioned to match vertical rebar from footing at bottoms of the wall units and that are positioned to match elevated tie-down structure, said plurality of wall units having an interior panel for attachment of inside wall surfacing said panel having a plurality of vertical attachment ridges spaced apart on the interior panel to provide space between the attachment ridges for positioning of plumbing, electrical lines and other wall-contained items and at least two horizontal attachment ridges one of the at least two horizontal attachment ridges being located at a top of the interior panel and another at a bottom of the interior panel for fastening the inside wall surfacing;

positioning the wall units vertically upright with the tie-down members in connective proximity to the vertical rebar;

attaching the tie-down members to the vertical rebar;

attaching adjacent wall units linearly and at corners;

attaching bottoms of the wall units to base flooring that is anchored appropriately with footing;

attaching tops of the tie-down members to elevated tie-down structure; and attaching inside wall surfacing to the attachment ridges on the interior panel.

19. A method as described in claim 18 wherein:

attaching the tie-down members to the vertical rebar includes pouring binding material such as concrete in tie-down spaces in which the tie-down members are housed; and attaching tops of the tie-down members to elevated tie-down structure includes pouring binding material such as concrete in a top-attachment trough.

* * * * *